US005333335A

United States Patent [19]

Gastle et al.

[11] Patent Number: 5,333,335

[45] Date of Patent: * Aug. 2, 1994

[54] PATIENT SUPPORT DEVICE

[76] Inventors: Thomas H. Gastle; James E. Gastle, both of P.O. Box 430, Lakefield, Ontario, Canada, K0L 2H0; Clarence Farrow, RR #3, Lakefield, Ontario, Canada, K0L 2H0

[ * ] Notice: The portion of the term of this patent subsequent to Jun. 1, 2010 has been disclaimed.

[21] Appl. No.: 29,166

[22] Filed: Mar. 10, 1993

Related U.S. Application Data

[63] Continuation-in-part of Ser. No. 889,964, May 29, 1992, Pat. No. 5,214,813.

[51] Int. Cl.[5] ..... A61G 1/00

[52] U.S. Cl. ..... 5/625

[58] Field of Search ..... 5/625, 627, 628; 383/10; 294/140, 152; 224/158

[56] References Cited

U.S. PATENT DOCUMENTS

| | | | |
|---|---|---|---|
| 2,400,759 | 5/1946 | Katz | 229/54 |
| 2,835,902 | 5/1958 | Fash | 5/627 |
| 2,899,692 | 8/1959 | Finken | 5/628 |
| 4,067,079 | 1/1978 | Buchman | 5/81.1 |
| 5,015,103 | 5/1991 | Mercer | 383/10 |
| 5,104,235 | 4/1992 | Brön struf et al. | 383/10 |

FOREIGN PATENT DOCUMENTS

| | | |
|---|---|---|
| 470601 | 1/1929 | Fed. Rep. of Germany . |
| 1919084 | 11/1969 | Fed. Rep. of Germany . |
| 864060 | 4/1941 | France . |
| 2023010 | 2/1979 | United Kingdom . |

*Primary Examiner*—Alexander Grosz

[57] ABSTRACT

Disclosed herein is a patient support device comprising a flexible support means, the support means having a pair of ends each of which includes a pair of hand holds, the hand holds being formed by an aperture which is dimensioned to receive the palm of a user's hand when lifting a patient and flap means hinged to one edge of the aperture permitting the flap means to engage the palm of the user's hand when lifting a patient, each of the hand holds being aligned with a respective hand hold so that, during use, the flap means may be nested together to form an integral handle with a folded cross section, the support means being formed of reinforced sheet material having sufficient rigidity to enable the integral handle to resist collapse, the support means being dimensioned to position the hand holds above a floor surface in order to minimize discomfort experienced by a user when lifting a patient.

7 Claims, 13 Drawing Sheets

PATIENT SUPPORT DEVICE

REFERENCE TO CO-PENDING APPLICATION

This application is a continuation in part of U.S. patent application Ser. No. 07/889,964 filed on May 29, 1992, now U.S. Pat. No. 5,214,813.

BACKGROUND OF THE INVENTION

1. Field of the Invention

The present invention relates to patient support devices.

2. Description of the Related Art

There are several versions of patient support devices currently in use, including those referred to as 'stretchers'. Stretchers are available in three versions, the first being with a wheeled undercarriage and otherwise referred to as 'gurneys' and the second being a non-wheeled but otherwise rigid unit carried by two or more personnel.

The third version is referred to as a 'collapsible' stretcher, in the sense that it can be reduced to a size smaller than its operative size. Such stretchers have found favor in cases where space is limited, or where the stretcher is to be carried. While exiting collapsible stretchers are satisfactory for their intended purpose, there are situations where the conventional stretchers are inappropriate. There are limits to the minimum size that these stretchers can be collapsed into. Smaller size usually must give way to a carrying handle which is nothing more than a simple nylon strap. However, such straps tend to put unwanted lateral 'squeezing' pressure on the hand causing pain and hand fatigue.

It is therefore an object of the present invention to provide a novel patient support device.

SUMMARY OF THE INVENTION

Briefly stated, the invention involves a patient support device comprising a flexible support means, the support means having a pair of ends each of which includes a pair of hand holds, the hand holds being formed by an aperture which dimensioned to receive the palm of a user's hand when lifting a patient and flap means hinged to one edge of the aperture permitting the flap means to engage the palm of the user's hand when lifting a patient, each of the hand holds being aligned with a respective hand hold so that, during use, the flap means may be nested together to form an integral handle with a folded cross section, the support means being formed of reinforced sheet material having sufficient rigidity to enable the integral handle to resist collapse, the support means being dimensioned to position the hand holds above a floor surface in order to minimize discomfort experienced by a user when lifting a patient.

BRIEF DESCRIPTION OF THE DRAWINGS

Preferred embodiments of the present invention will now be described, by way of example only, with reference to the appended drawings in which.

DESCRIPTION OF THE PREFERRED EMBODIMENTS

Referring to the figures, there is provided a flexible stretcher 120 formed of a reinforced flexible material such as polyester reinforced vinyl. The stretcher 120 has four corners, each of which is reinforced with a patch shown at 120*a*. The corner is further cut to form a hand hold 120*b*. The cut is made to form a folded flap which, in use, follows the inside contour of the hand thus allowing additional comfort. The user's hand will be wrapped around the fold so that the hand contacts the surface of the flexible material rather than the edge thereof.

Furthermore, the flap together with the patch forms a handle with a thickened cross section. The hand hold provides a relatively rigid handle to resist lateral pressure against the hand that would otherwise constrict the hand. However, with the flap in its unused position, the handle once again becomes sufficiently flexible to be folded for storage.

The flexible stretcher 120 has the particular feature of collapsing when carrying human patients, veternary patients such as dogs and calves or other objects. This collapsing effect serves to cradle the animal in the stretcher and to make it more difficult for the animal to fall off the stretcher. Further, the collapsing effect permits the user to begin the lift in a more upright position. It should also be pointed out that the stretcher is intended to be used with one person at each end so that the work required to lift the animal is cut in half.

Figure 3:
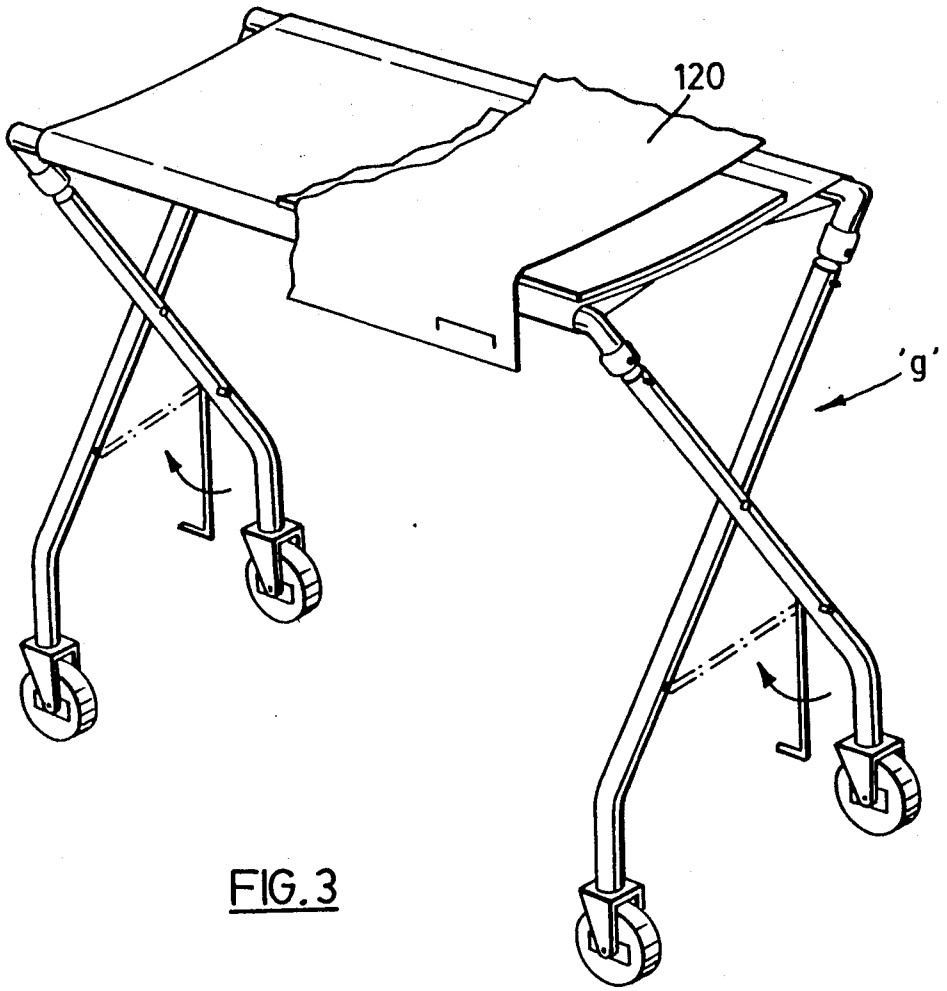
FIG. 3 is a perspective view of a gurney making use of the stretcher illustrated in FIG. 2.

As shown in FIG. 3 the stretcher 120 is particularly useful in that it can be used to lift animals onto gurneys such as that shown at 'g' and to transfer animals from gurneys to other exam, x-ray and surgery tables with much less physical effort required.

Figure 1:
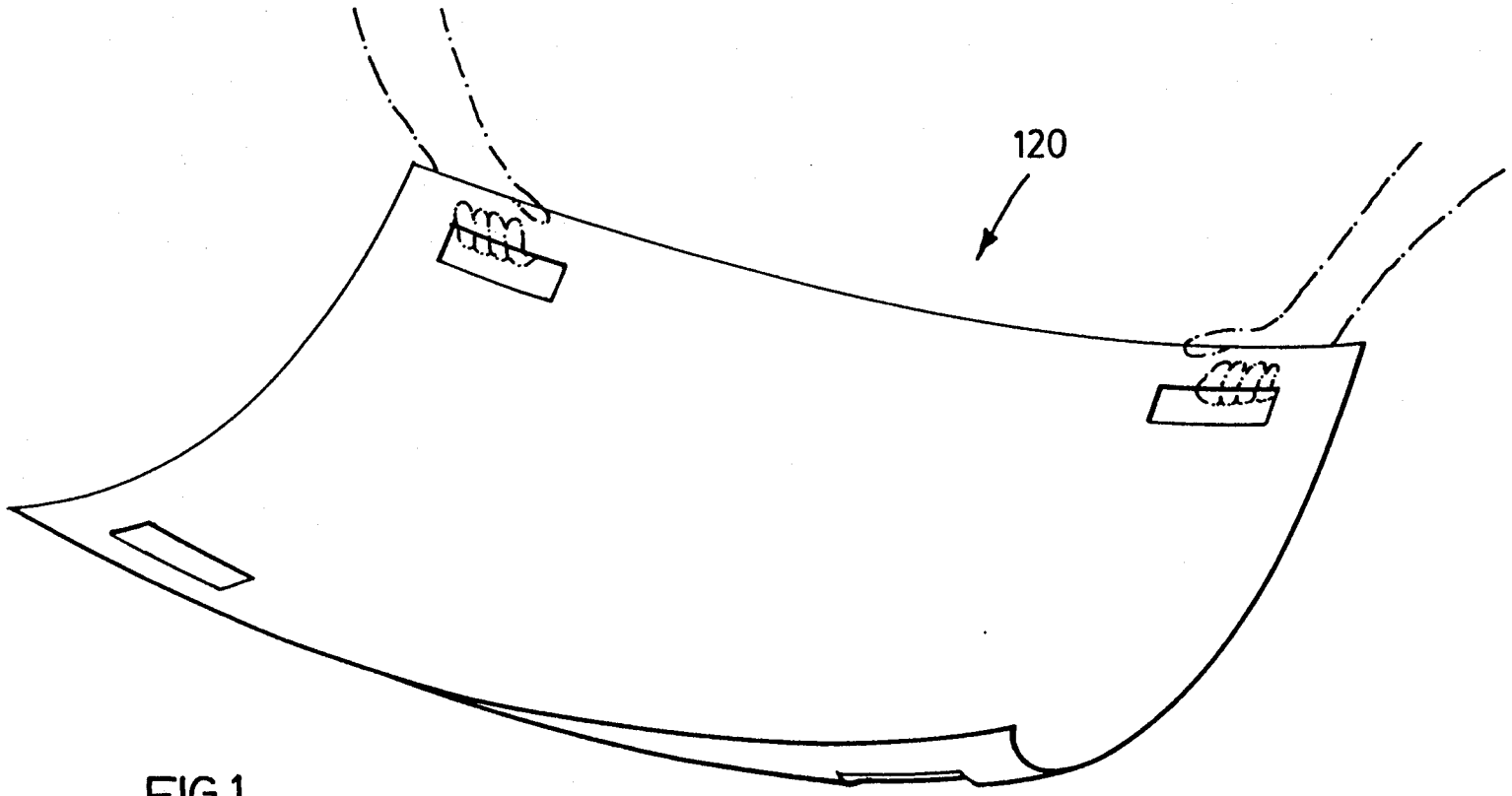
FIG. 1 is a perspective view of a stretcher.
Figure 2A:
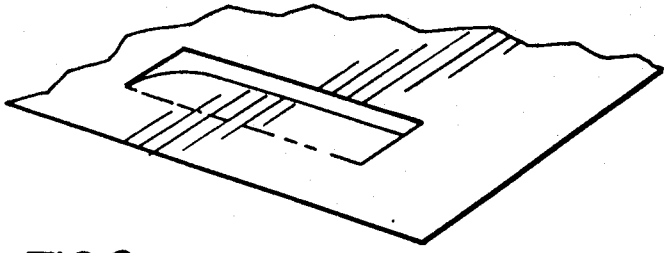
FIG. 2*a* is a fragmentary perspective view of one portion of the stretcher illustrated in FIG. 2.
Figure 2B:
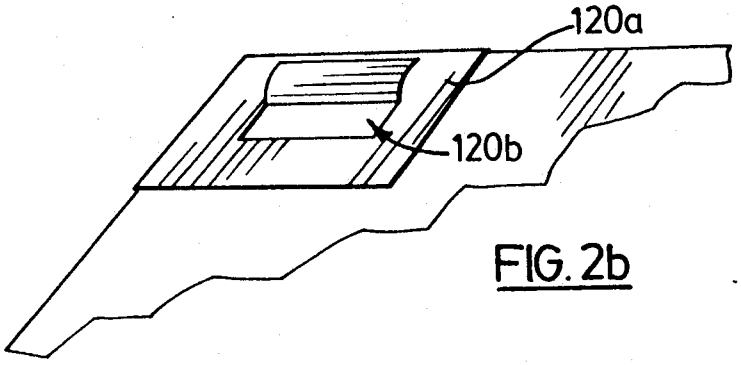
FIG. 2*b* is another fragmentary perspective view of the portion illustrated in FIG. 2*a;*
Figure 2:
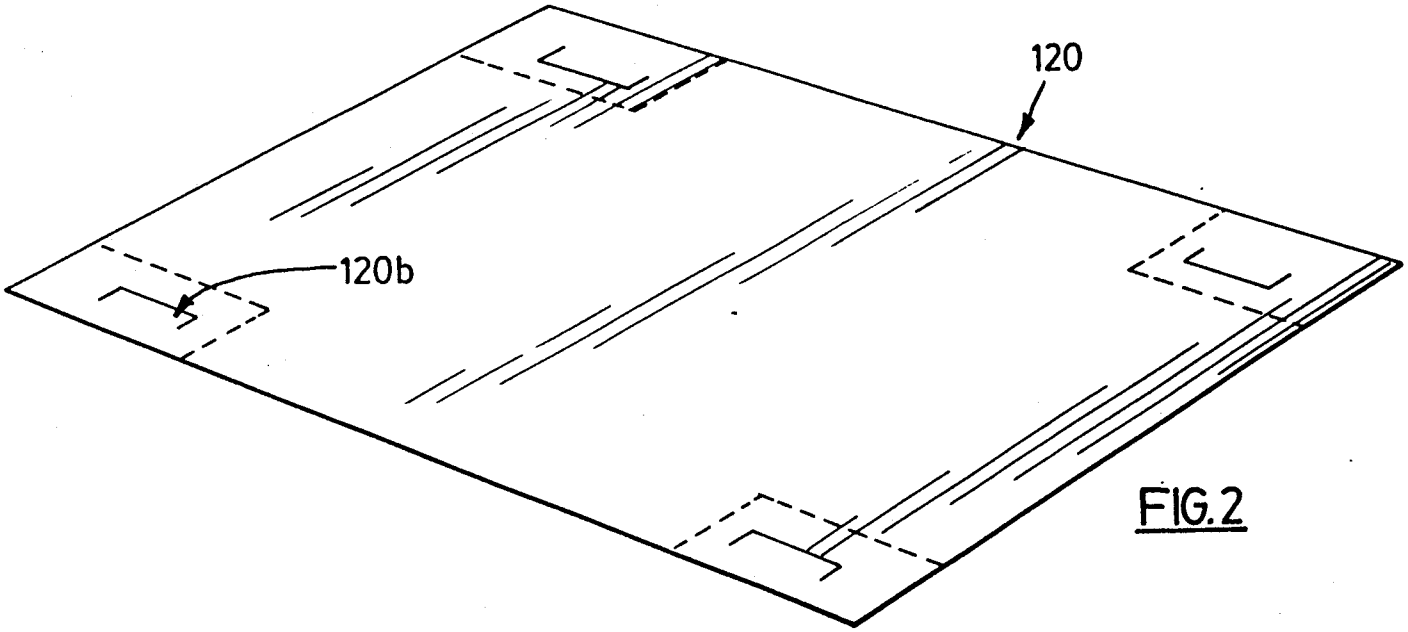
FIG. 2 is another perspective view of the stretcher illustrated in FIG. 1.
Figure 4:
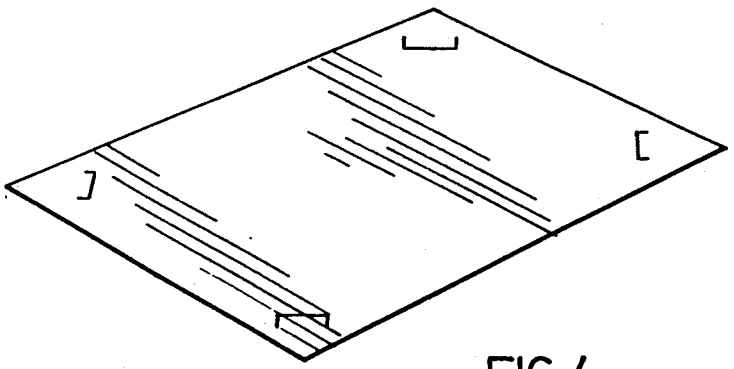
FIG. 4 is a perspective view of another stretcher.
Figure 5:
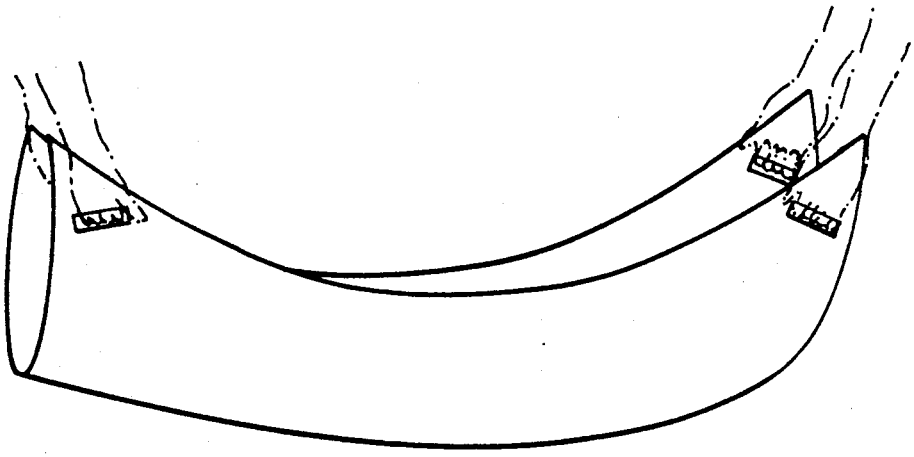
FIG. 5 is a perspective view of the stretcher illustrated in FIG. 4 in an operative position.

If desired, the hand holds may be formed on an angle as shown in FIGS. 4 and 5. In this case, the hand hold will be positioned to permit the hand to be in a natural gripping position rather than in an extended position as might be necessary with the hand hold not angled as in the previous embodiment.

Figure 6A:
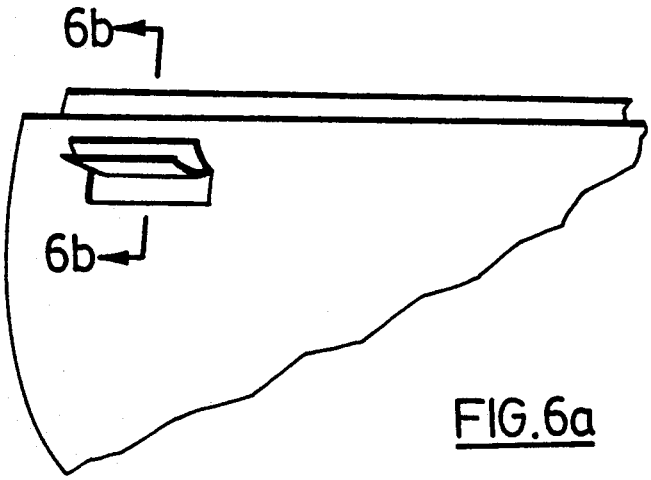
FIG. 6*a* is a fragmentary perspective view of a portion of the stretcher illustrated in FIG. 6.
Figure 6B:
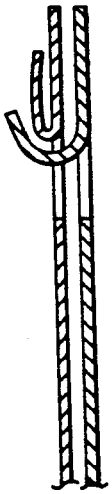
FIG. 6*b* is a sectional view taken on arrow 6*b* of FIG. 6*a;*
Figure 6:
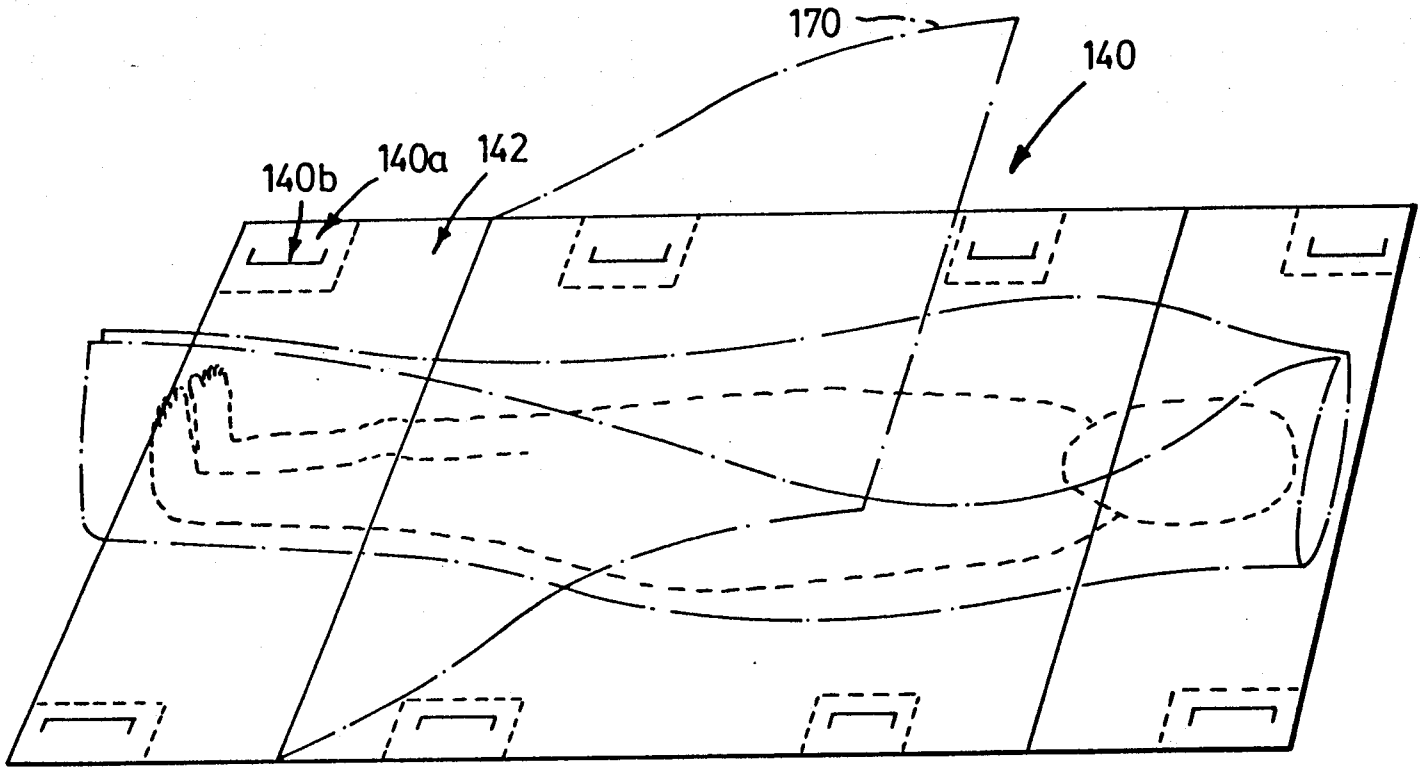
FIG. 6 is a perspective view of yet another stretcher with an operative position shown in phantom.
Figure 7:
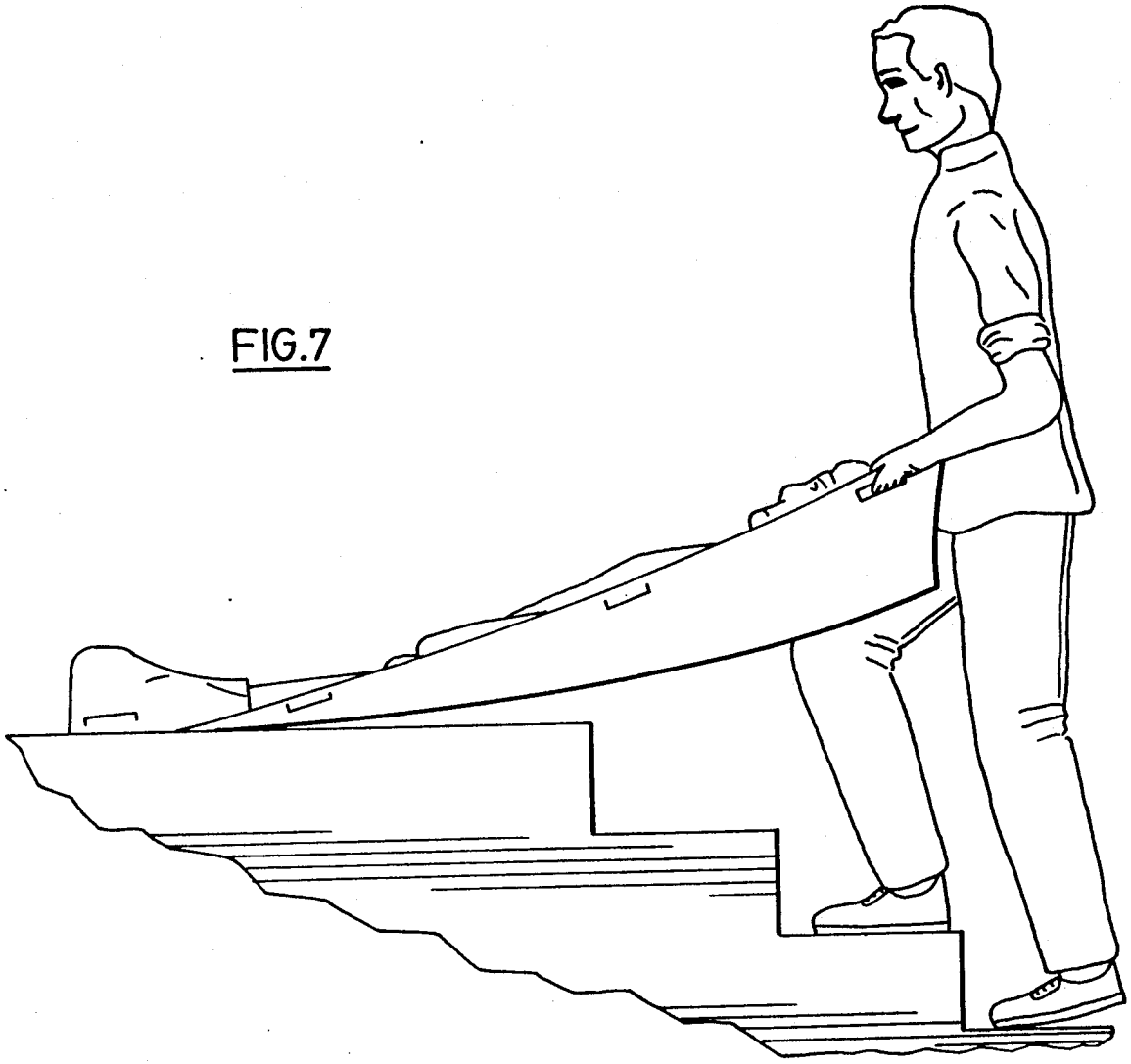
FIG. 7 is a side view of the stretcher illustrated in FIG. 6 in another operative position.

Referring to FIGS. 6 and 7, there is provided another flexible stretcher 140 formed of a reinforced flexible material such as polyester reinforced vinyl as useful as an evacuation stretcher. The stretcher 140 has four corners, each of which is reinforced with a patch shown at 140*a*. The corner is further cut to form a hand hold 140*b*. The cut is made to form a folded flap to function as does the flap in the earlier embodiment. In addition, a number of other hand holds are provided between the handle in the corners to allow a number of rescue personnel to carry the stretcher side-by-side.

A particular feature of the stretcher 140 is the use of pockets 142 located at each end thereof and coextensive with the hand holds 140*b*. The pockets 142 are further and which are dimensioned to receive a portion of the patient to be carried in the stretcher, such as for example, the patient's feet. The pockets 142 at each end allow usage in impaired sight conditions and prevent the patient from slipping off the stretcher when being carried on an incline.

The stretcher 140 lends itself to be used either with two or more rescue personnel as shown for example in phantom in FIG. 6. In this case, the stretcher 140 has sufficient width so that it can be wrapped around a patient and the hand holds can be nested with one another to permit the rescue personnel to carry the stretcher with one hand while using the other hand to negotiate stair wells and the like. The nesting feature can be seen in FIGS. 6*a*, 6*b* and forms a snug integral fit for the rescue personnel. In fact, the nesting tends to increase the strength of the hand hold by doubling the thickness of material that is folded, the fold forming a structure that resists collapse.

The stretcher 140 may also be used by a single rescuer as for example shown in FIG. 7. In this case, the rescuer can insert the patient's feet in one pocket which prevents the patient from slipping off the end of the stretcher. The rescuer may then grip the other end of the stretcher with the two hand holds and drag the patient along the floor. If stairs or other obstructions must be passed, the stretcher can maintain the buttocks and back off the floor to prevent injury while the feet will absorb the obstruction. If desired, the stretcher may also be provided with a cushion layer to protect the patient from such obstructions even further.

Figure 7A:
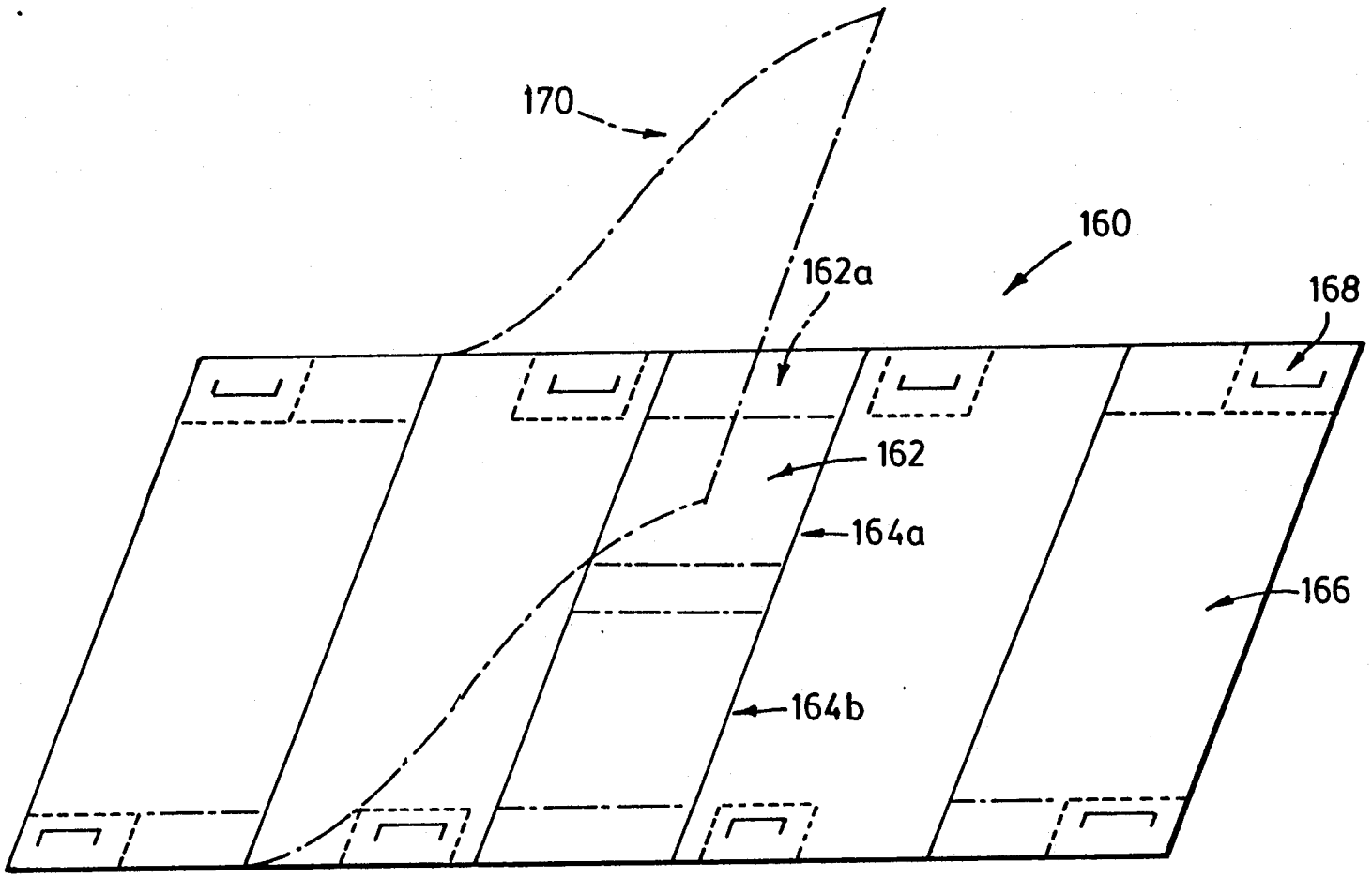
FIG. 7*a* is a perspective view of another stretcher.

FIG. 7*a* illustrates still another stretcher 160 wherein a central sleeve 162 is formed on the stretcher by bonded seams shown by chain dotted lines at 162*a* to form two openings as shown at 164*a*, 164*b*, each for other limbs of the patient for example, the arms thereof.

As can be seen from FIG. 7*a* (and will described in more detail below), the bonded seam 162*a* that forms the central sleeve is also used to form the pockets 166 and are aligned with the reinforced hand holds 168, thus allowing the flap of the hand hold to be the double thickness of the material along with the additional thickness of the reinforcement patch.

As with the stretchers 120 and 140, the stretcher 160 has the particular feature of collapsing when carrying a patient. This collapsing effect serves to cradle the patient in the stretcher and to make it more difficult for the patient to fall off the stretcher. Further, the collapsing effect permits the rescue personnel to begin the lift in a more upright position.

The handles lie flat in their unused position and thereby do not interfere with the folding of the stretcher for storage. The stretcher may be easily folded into a relatively small package thereby requiring relatively little storage space in an aircraft or other rescue vehicle. The rescuer may easily carry the stretcher on a belt-located pouch, in a pocket or the like and thereby not be hindered in his efforts to locate a victim.

Referring to FIG. 7*a*, the stretcher 160 may also be provided with a cover portion 170 to provide heat retention, or protection against the elements for the patient. In this case, the cover portion may either be integral with or be attached to the pocket and be stored therein if desired.

Other restraint straps may of course be incorporated into the stretcher as desired.

Figure 10:
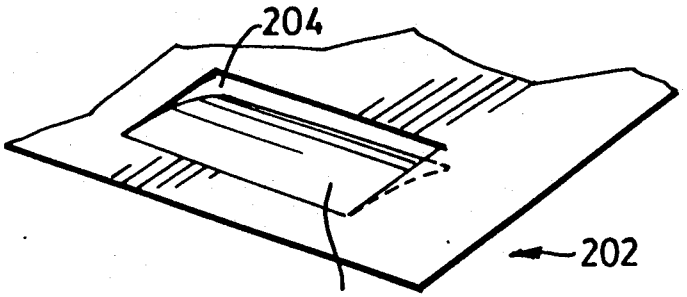
FIG. 10 is another perspective view of the stretcher illustrated in FIG. 8.
Figure 9:
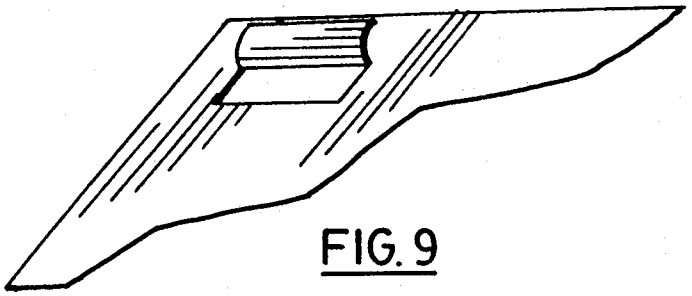
FIG. 9 is a fragmentary perspective view of the stretcher illustrated in FIG. 8.
Figure 8:
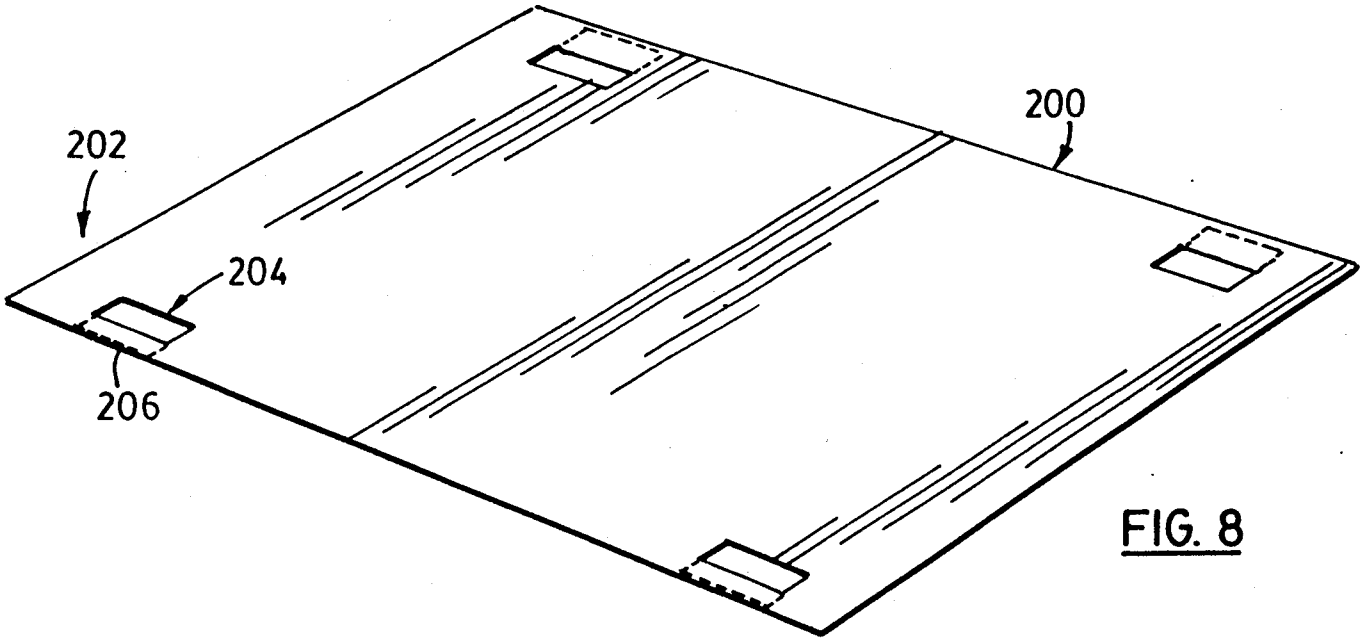
FIG. 8 is a perspective view of yet another stretcher.
Figure 11:
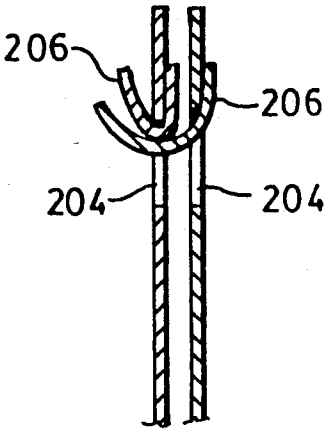
FIG. 11 is sectional view of the stretcher illustrated in FIG. 8 in an operative position.

Referring to FIG. 8, there is provided yet another flexible stretcher 200 formed of a reinforced flexible material such as polyester reinforced vinyl. The stretcher 200 has four corners 202, each of which has an aperture 204 which is shaped to fit the palm of a user's hand. Attached to the corner 202 adjacent the aperture 204 is a patch shown at 206. The patch is oversized so that it forms a flap that can be passed through the aperture as shown in FIGS. 9 and 10. The flap may thus be folded in the same manner as in the earlier embodiments to form a hand hold. This alternative may in some cases be desirable as a means to provide similar stiffness to comfort the hand while reducing the amount of material for its construction. In use, the flaps 206 may be overlapped in the same manner as earlier embodiments and as shown in FIG. 11.

Figure 12:
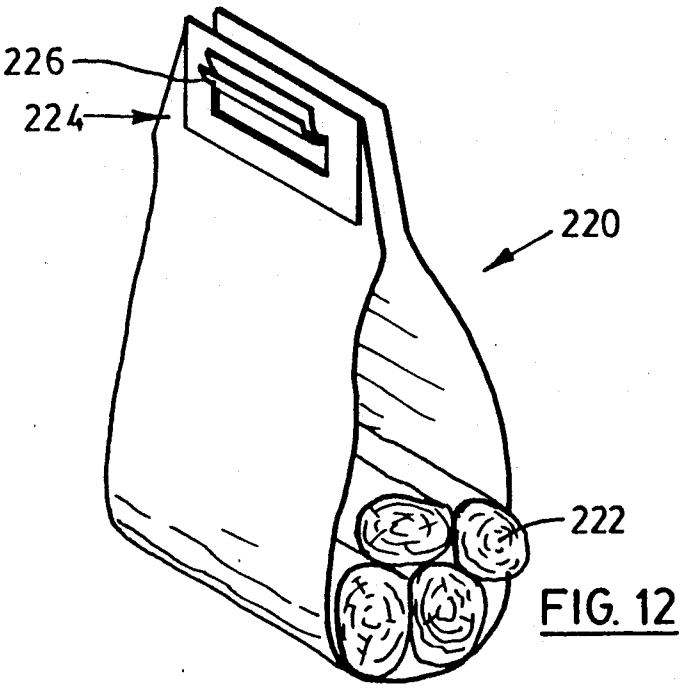
FIG. 12 is a perspective view of an article carrier in an operative position.
Figure 12A:
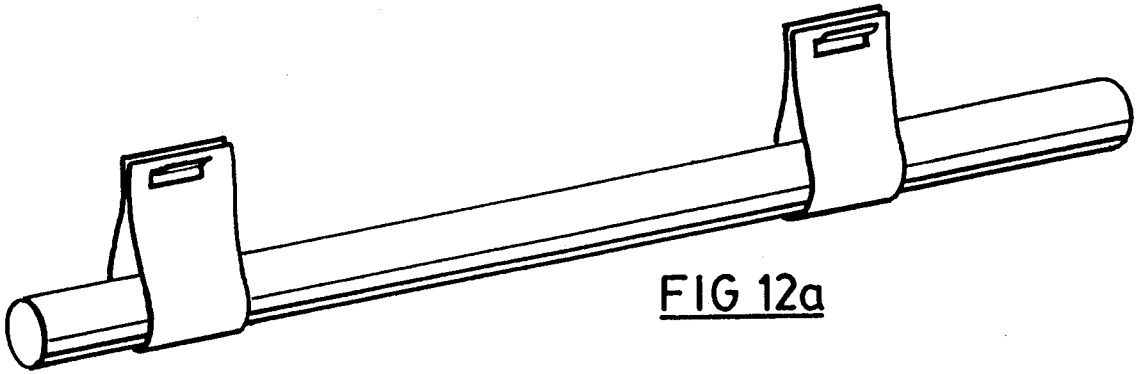
FIG. 12*a* is a perspective view of two of the article carriers illustrated in FIG. 12 in an operative position.

Referring to FIG. 12, there is provided a device 220 for carrying articles such as fire wood 222 which utilizes two hand holds 224 on either side thereof and which provide the overlapping flaps 226. The device 220 is significant in that the benefits of the overlapping flaps are also available for carrying objects such as fire wood, boxes or the like where the length of the object being carried is relatively short. Furthermore, two or more devices 220 may be used as slings to lift long objects such as poles as shown in FIG. 12*a*.

Figure 13A:
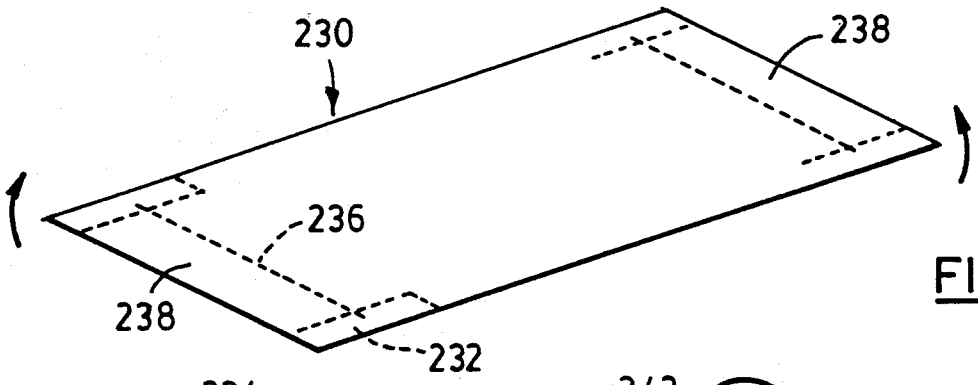
FIG. 13*a* is a perspective view of a blank for making a stretcher.
Figure 13B:
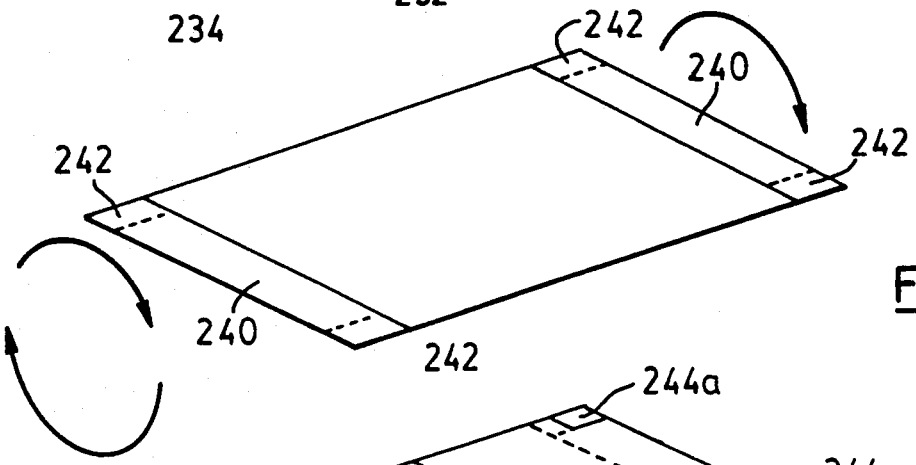
FIG. 13*b* is a perspective view of the blank illustrated in FIG. 13*a* following a manufacturing step.
Figure 13C:
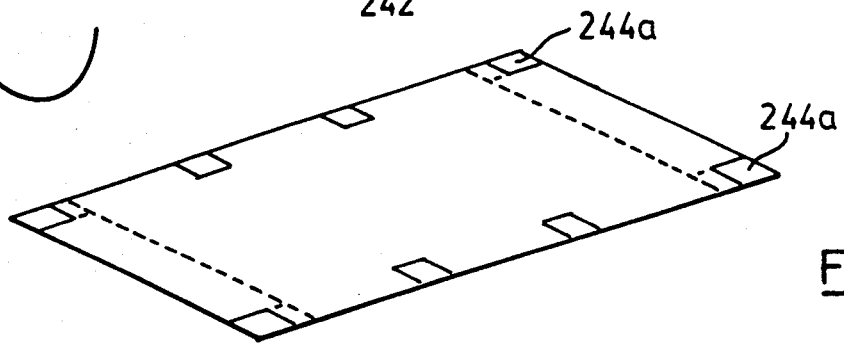
FIG. 13*c* is a perspective view of the blank illustrated in FIG. 13*a* following another manufacturing step.
Figure 13D:
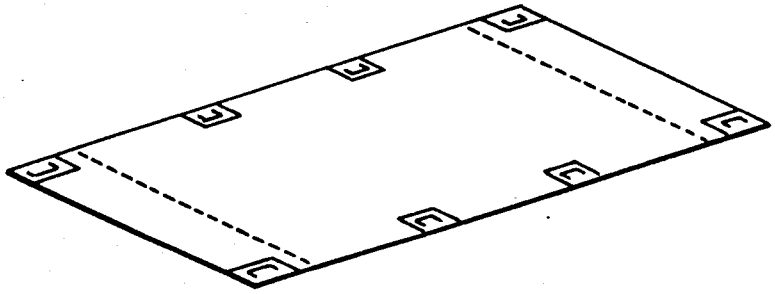
FIG. 13*d*is a perspective view of the blank illustrated in FIG. 13*a* following yet another manufacturing step.

One technique to make a stretcher is shown in FIGS. 13*a* to 13*d*. First a blank 230 is formed from a reinforced material such as 18 ounce polyester reinforced vinyl. The blank is provided with an adhesive receiving zone 232 on each corner 234. Thereafter, a fold line 236 is formed on each end midway through the adhesive receiving zones 232 to form flaps 238. The flaps are then folded about the fold lines 236 to form pockets shown at 240 in FIG. 13*b*, each with a relatively wide bonded seam 242. The so formed blank 230 is then placed upside down and reinforcing patches 244*a* are bonded at the locations shown. In particular, the patches 244*a* on the corners of the stretchers are conveniently located on the bonded seams 242, thereby to form a triple layer of material in the corners. Finally, the reinforced locations are punched to form handles as shown in FIG. 13*d*.

Figure 14:
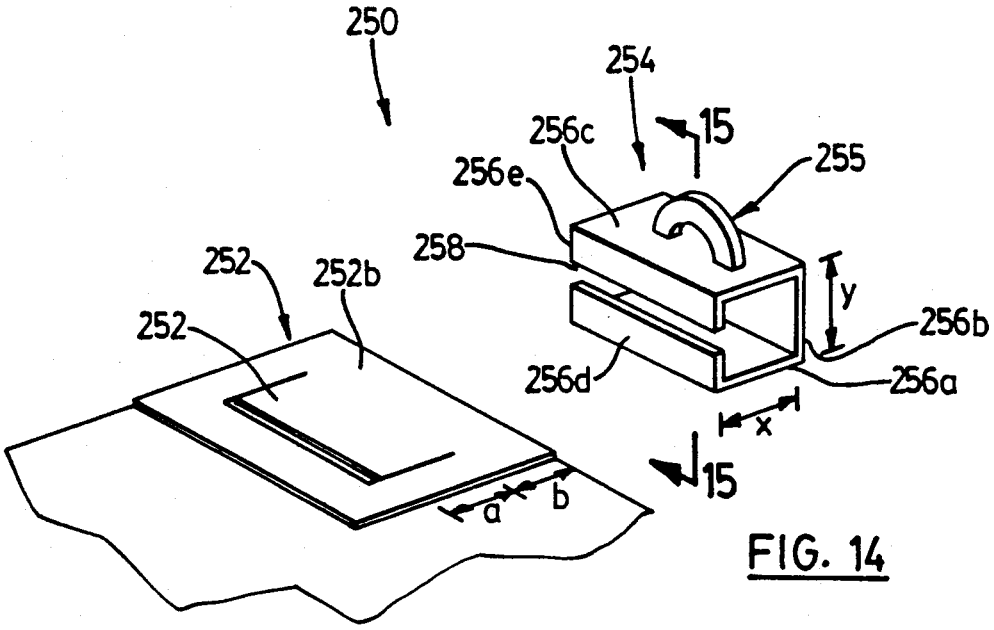
FIG. 14 is a part fragmentary perspective view of two components of a lifting device.
Figure 15:
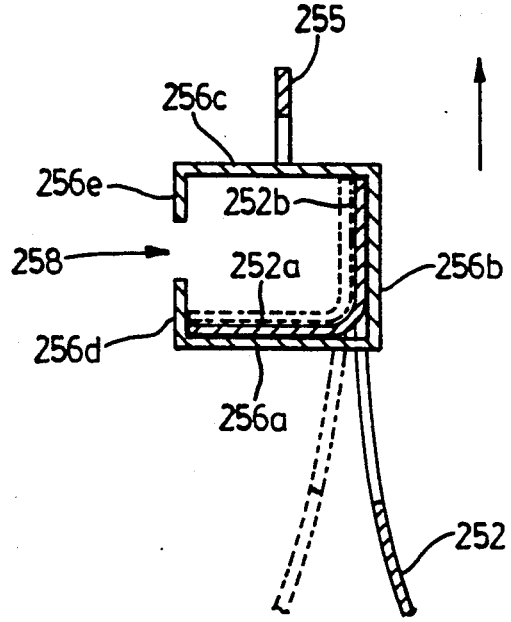
FIG. 15 is a sectional view taken on line 15—15 of FIG. 14.
Figure 16:
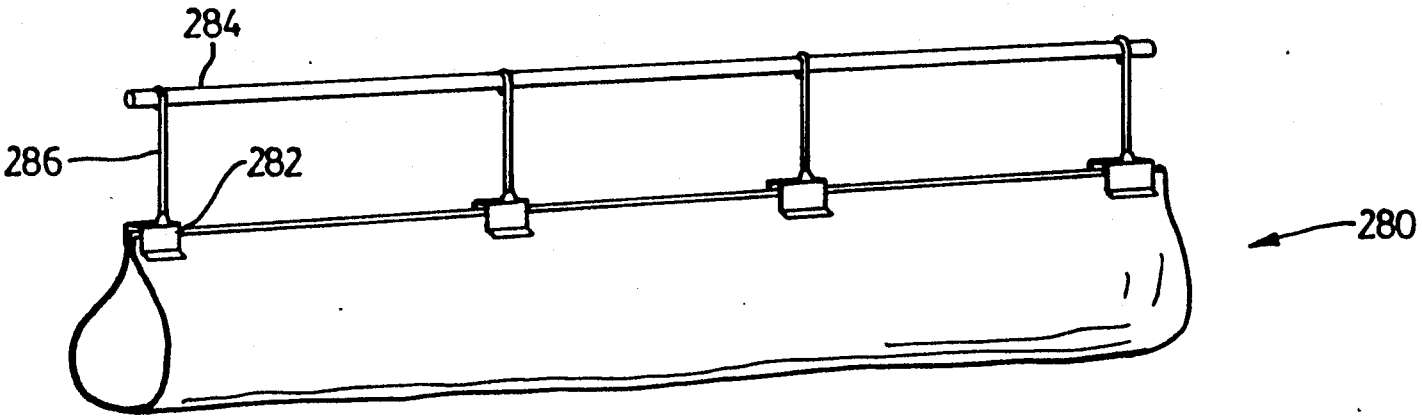
FIG. 16 is a perspective view of a lifting device.

Referring to FIGS. 14 and 15, there is provided a coupling device useful for coupling articles, including an eye portion 252 and a hook portion 254. The hook portion is metallic and rectangular sectioned with two arms elements in the form of panels 256*a*, 256*b* and includes a lifting ring 255. One of the sides has an elongate opening 258 to receive the eye portion having a first wing element 252*a* and a second wing element 252*b*. A particular feature of the coupling device is that the dimensions of the wing elements 'a', 'b' are approximately equal the dimensions 'x' and 'y' of the panels 256*a* and 256*b* of the hook member. Furthermore, the hook member is provided with retention means in the form of panels 256*c* and 256*d* which retains the wing elements in position against the respective panels. The rectangular shape of the hook member provides additional panels 256*c* and 256*e* to form a relatively narrow opening through which the eye portion can pass to connect with or be released from the hook portion. This causes a locking effect when one or more of the hand holds are inserted in the lifting member as shown in FIG. 15. The locking effect arises from the close dimensions between the lifting member and the hand hold and the natural bias of the material toward its flat position. This natural bias urges the wing element 252*a* outwardly against the panel 256*a* and the wing element 252*b* against the panel 256*c*. The wing elements can only be removed by manipulating the wing elements hold through the opening 258. As can be seen by the dashed lines in FIG. 15, two eye portions may be overlapped in the hook portion and thereby provide a Simple yet rugged technique to lift an object supported by the eye portions, such as the hand holds of a stretcher as described above. The coupling device may be combined with a number of such devices to form a lifting device 280 as shown in FIG. 16. In this case, four coupling devices 282 are attached to a bar 284 by way of straps 286.

While the eye portion may be formed from similar material as the earlier embodiments, the eye portion may also be made from relatively rigid yet resilient material such as molded plastics, provided the wing elements tend to bias themselves to a co-planar orientation. It is the biasing of the wing elements toward this coplanar relation and the correspondence resistance provided by the arm elements to such coplanar relation that forces the wing elements against the stops and thereby firms up the connection of the eye portion with the hook portion. Release of the hook portion from the eye portion requires that the wing elements be removed from their position against the panels and, in the case of the arrangement shown in FIG. 14 and 15, the wing elements being oriented either one at a time or together out through the narrow opening 258 between the panels 256*d* and 256*e*.

The eye portion hold may be formed on any number of articles including rigid articles such as boxes or for that matter may be formed on the free ends of a sling. In any case, the hood and eye members provide a lifting device that is economical to fabricate, rugged in use and offers a high degree of safety against inadvertent release.

Figure 15A:
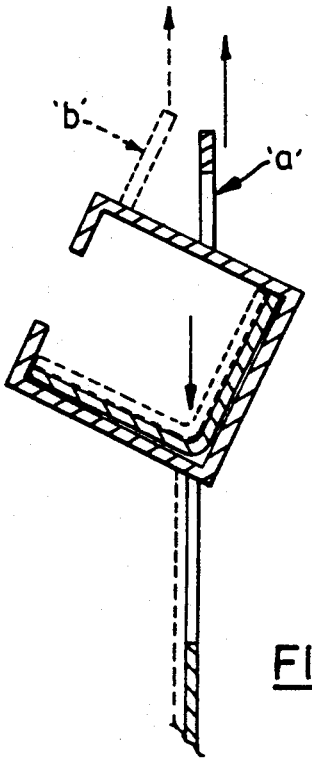
FIG. 15*a* is an alternative sectional view to that of FIG. 15.

The location of the ring 255 is selected to maintain the positions of the wing elements and the panels. If desired, the ring 255 may be inclined as shown at 'a' in FIG. 15*a* or shifted toward the right angled remote end 256*e* as shown at 'b' in figure 15*a* to urge the hinged connection of the wing elements toward the corner formed by the panels 256*a*, 256*b*.

While the eye and hook portions are showing to have a significant 'depth' corresponding to the width of the hand hold in the stretchers illustrated above, it will be understood that the hook and eye members may be of any reasonable 'depth' (including being relatively narrow) provided that the dimensions 'a' and 'b' correspond with the dimensions 'x' and 'y' in such a manner to provide the fit as above described. There may of course be some variance to this fit. However, the greater the degree of bias in the wing elements, the greater the fit between the hook and eye portions.

Figure 17:
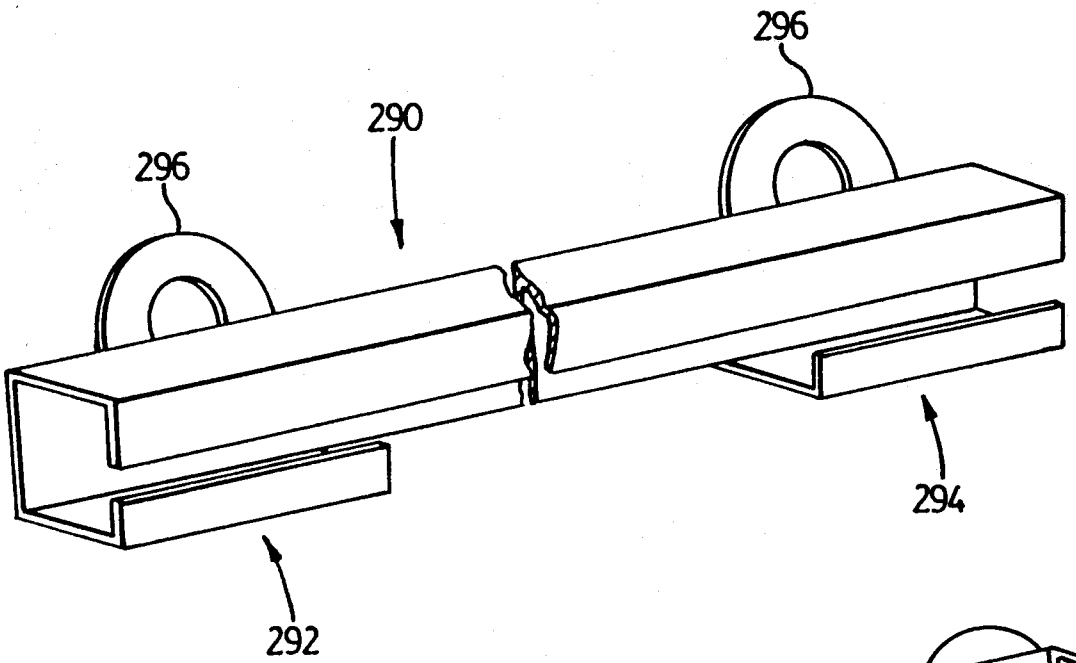
FIG. 17 is a part fragmentary perspective view of one component used in a lifting device.
Figure 18:
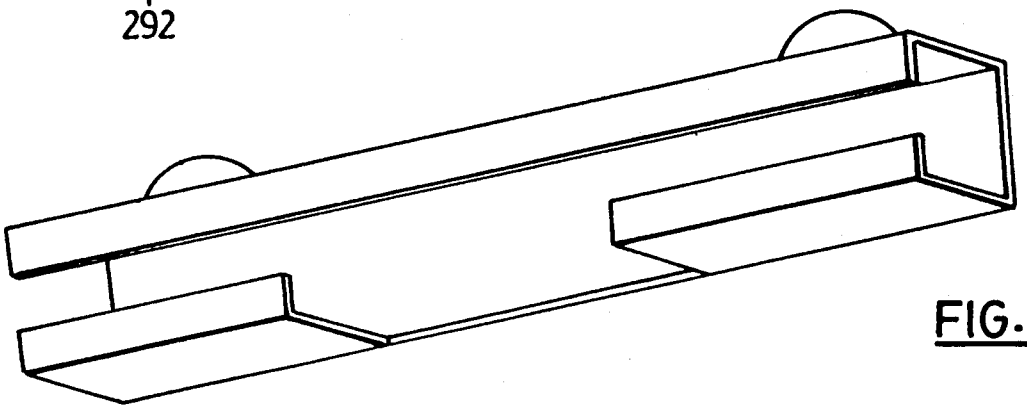
FIG. 18 is another part fragmentary perspective view of the component illustrated in FIG. 17.

Shown in FIGS. 17 and 18 is an alternative lifting member 290 with a number of lifting portions 292 and 294. The lifting member 290 is identical in cross section to that shown in FIG. 15. In this case, the lifting member may be made an integral part of a lifting device. For example, the lifting member 290 could be attached to an appropriate location on the landing gear or fuselage of a helicopter.

While the above embodiments refer to patients, animals rescue and veterinary personnel, it will of course be understood that all of the above embodiments may be used in situations other than those specifically named.

We claim:

1. A patient support device comprising a flexible support means, said support means having a pair of ends each of which includes a pair of hand holds, said hand holds being formed by an aperture which is dimensioned to receive the palm of a user's hand when lifting a patient and flap means hinged to one edge of said aperture permitting said flap means to engage the palm of the user's hand when lifting a patient, each of said hand holds being aligned with a respective hand hold and said support means having a sufficient width so that, during use, said support means may be wrapped around a patient and said flap means may be nested together to form an integral handle, said support means being formed of reinforced sheet material having sufficient rigidity to enable said integral handle to resist collapse, said support means being dimensioned to position said hand holds above a floor surface in order to minimize discomfort experienced by a user when lifting a patient.

2. A patient support device as defined in claim 1 wherein said aperture and said flap means are formed together by a cut out.

3. A patient support device as defined in claim 1 wherein said flap is formed from a blank of material which is bonded to one side of said aperture.

4. A patient support device as defined in claim 1 wherein said support means includes at least one pocket located at one end of said support means to receive a body part of said patient.

5. A patient support device as defined in claim 1 wherein said pockets are formed by forming a bonded seam between adjacent sheets of said material and said aperture being formed in said bonded seam.

6. A patient support device as defined in claim 1 wherein said support means has four corners, four hand holds each of which is located in a respective one of said corners and an additional pair of hand holds each of which is located between said corners.

7. A patent support device as defined in claim 6 further comprising a pair of pockets on each end thereof and coextensive with said hand holds.

* * * * *